US006709275B1

(12) United States Patent
Ihde

(10) Patent No.: US 6,709,275 B1
(45) Date of Patent: Mar. 23, 2004

(54) TOWING CONNECTOR

(75) Inventor: David H. Ihde, Osage City, KS (US)

(73) Assignee: Hopkins Manufacturing Corporation, Emporia, KS (US)

( * ) Notice: Subject to any disclaimer, the term of this patent is extended or adjusted under 35 U.S.C. 154(b) by 0 days.

(21) Appl. No.: 10/213,886

(22) Filed: Aug. 6, 2002

(51) Int. Cl.[7] ..... H01R 33/00
(52) U.S. Cl. ..... 439/35; 439/189
(58) Field of Search ..... 439/35, 34, 52, 439/189, 49, 50, 51, 956, 43; 280/422

(56) References Cited

U.S. PATENT DOCUMENTS 4,460,811 A * 7/1984 Murr et al. ..... 200/51.03
4,718,853 A * 1/1988 Orbanic ..... 439/35
4,739,129 A * 4/1988 Owen et al. ..... 200/51.04
4,781,393 A * 11/1988 Jeter ..... 307/10.1
5,184,960 A * 2/1993 Hopkins et al. ..... 439/35
5,281,147 A * 1/1994 Hughes ..... 439/35
5,442,170 A * 8/1995 Kreft et al. ..... 250/229
5,514,009 A * 5/1996 Hughes ..... 439/35
5,683,261 A * 11/1997 Ahles et al. ..... 439/189
5,766,020 A * 6/1998 Hughes ..... 439/35
6,422,884 B1 * 7/2002 Babasick et al. ..... 439/222

* cited by examiner

*Primary Examiner*—Ross Gushi
(74) *Attorney, Agent, or Firm*—Hovey Williams LLP

(57) ABSTRACT

A towing connector (10) operable to electrically couple a towed vehicle's (12) wiring with any towing vehicles (14) wiring broadly comprises a housing (20,120), a plurality of wires (26) within the housing (20,120) and electrically coupling a first receptacle (22,122) with a second receptacle (24,124), and a mechanism (54,154) operable to modify an electrical arrangement of the wires (26). The mechanism (54) preferably comprises a plug (56) removably mounted within the housing (20) and a mount (58) fixedly mounted within the housing (20). The plug (56) may be removed, rotated 180 degrees and reinserted within the housing (20), thereby modifying the electrical arrangement of the wires (26). Alternatively, the mechanism (154) may comprise a double-pole double-throw (DPDT) switch (188) disposed within the housing (120).

6 Claims, 5 Drawing Sheets

TOWING CONNECTOR

BACKGROUND OF THE INVENTION

1. Field of the Invention

The present invention relates to towing connectors. More particularly, the present invention relates to a towing connector for electrically coupling any towed vehicle's wiring with a towing vehicle's wiring.

2. Description of Prior Art

Towing connectors are commonly used to connect wiring of towed vehicles with wiring of towing vehicles. Unfortunately, wiring inside these connectors may have different electrical arrangements depending upon, among other things characteristics of the towed vehicles and the towing vehicles. Two of the most common electrical arrangements, pass-thru and cross-over, are very similar, differing in that two wires are electrically crossed in a cross-over type electrical arrangement.

Approximately 50% of vehicles use a pass-thru type electrical arrangement and approximately 50% use a cross-over type electrical arrangement. Therefore, retailers are often required to stock even numbers of connectors having each electrical arrangement. Additionally, consumers are required to know which electrical arrangement they need.

If a consumer purchases a connector with an incorrect electrical arrangement, they must disassemble and re-wire the connector. Doing so, requires the use of tools and is often extremely confusing and difficult for consumers to accomplish.

Accordingly, there is a need for an improved towing connector that overcomes the limitations of the prior art.

SUMMARY OF THE INVENTION

The present invention overcomes the above-identified problems and provides a distinct advance in the art of towing connector for electrically coupling any towed vehicle's wiring with a towing vehicle's wiring. The connector broadly comprises a housing, a first receptacle mounted within a first portion of the housing for electrically coupling with the wiring of the towing vehicle, a second receptacle mounted within a second portion of the housing for electrically coupling with the wiring of the towed vehicle, and a plurality of wires electrically coupling the first receptacle with the second receptacle.

In order to make the wiring of the towed vehicle compatible with the wiring of the towing vehicle, the wires must be arranged in a specific electrical arrangement. The arrangement defines the manner in which signals are transmitted from the wiring of the towing vehicle to the wiring of the towed vehicle through the connector. Thus, the arrangement is dependant upon specific characteristics of the towed vehicle and the towing vehicle. Therefore, in order for the connector to be operable with different towed vehicles, the arrangement may need to be modified.

In a first instance, each of the wires preferably electrically couple each terminal of the first receptacle with a corresponding terminal of the second receptacle. For example, a first terminal of the first receptacle is preferably electrically coupled with a first terminal of the second receptacle. Additionally, a second terminal of the first receptacle is preferably electrically coupled with a second terminal of the second receptacle. Furthermore, a third terminal, a forth terminal, a fifth terminal, and a sixth terminal of the first receptacle are preferably individually electrically coupled with a third terminal, a forth terminal, a fifth terminal, and a sixth terminal of the second receptacle. In this manner, the connector operates as a pass-thru type connector.

In a second instance, the first terminal of the first receptacle is preferably electrically coupled with the second terminal of the second receptacle. Additionally, the second terminal of the first receptacle is preferably electrically coupled with the first terminal of the second receptacle. The remaining terminals of the first receptacle are preferably electrically coupled to the remaining terminals of the second receptacle as described for the first instance above. In this manner, the connector operates as a cross-over type connector, with the first and second terminals of the first receptacle electrically crossed with the first and second terminals of the second receptacle.

The connector of the present invention can operate as either the pass-thru type connector or the cross-over type connector described above using a mechanism that modifies the electrical arrangement of two or more of the wires. In a first embodiment of the connector, the mechanism preferably comprises a plug removably mounted within the housing and a mount fixedly mounted within the housing. A first terminal of the plug is preferably electrically coupled to the first terminal of the first receptacle through a first wire. A second terminal of the plug is preferably electrically coupled to the second terminal of the first receptacle through a second wire. A first terminal of the mount is preferably electrically coupled to the first terminal of the second receptacle through a third wire. A second terminal of the mount is preferably electrically coupled to the second terminal of the second receptacle through a fourth wire. The third terminal, the forth terminal, the fifth terminal, and the sixth terminal of the first receptacle are preferably individually electrically coupled with the third terminal, the forth terminal, the fifth terminal, and the sixth terminal of the second receptacle through a fifth wire, a sixth wire, a seventh wire, and an eighth wire, respectively.

The plug is preferably designed to be received within the housing in either one of two orientations, with the orientations being approximately 180 degrees apart. Additionally, the terminals of the plug are preferably designed to engage the terminals of the mount in either one of the two orientations. Thus, the plug may be removed, rotated 180 degrees and reinserted within the housing. This allows a user to change the electrical arrangement of the wires from the first instance to the second instance described above, by operating the mechanism.

When the plug is inserted into the housing in a first orientation, the first terminal of the first receptacle is electrically coupled to the first terminal of the second receptacle, through the first wire, the first terminal of the plug, the first terminal of the mount, and the third wire. Additionally, the second terminal of the first receptacle is electrically coupled to the second terminal of the second receptacle, through the second wire, the second terminal of the plug, the second terminal of the mount, and the fourth wire. In this case, the electrical arrangement corresponds to the first instance, with the connector operating as the pass-thru type connector.

When the plug is inserted into the housing in a second orientation, the first terminal of the first receptacle is electrically coupled to the second terminal of the second receptacle, through the first wire, the first terminal of the plug, the second terminal of the mount, and the fourth wire. Additionally, the second terminal of the first receptacle is electrically coupled to the first terminal of the second receptacle, through the second wire, the second terminal of the plug, the first terminal of the mount, and the third wire. In this case, the electrical arrangement corresponds to the second instance, with the connector operating as the cross-over type connector.

In use, the user physically joins the towed vehicle to the towing vehicle and physically mates the connector with a receiver electrically coupled with the wiring of the towed vehicle. In this manner, components of the towed vehicle can receive the signals from the wiring of the towing vehicle through the connector. If the components of the towed vehicle do not operate properly, the user may remove and rotate the plug approximately 180 degrees. The user then reinserts the plug into the housing. In this manner, the user can change the electrical arrangement between the first instance and the second instance described above.

A mechanism of a second embodiment of the connector comprises a double-pole double-throw (DPDT) switch disposed within the housing. A first center terminal of the switch is preferably electrically coupled with the first terminal of the first receptacle and a second center terminal of the switch is preferably electrically coupled with the second terminal of the first receptacle. A first pair of side terminals of the switch are preferably individually electrically coupled with the first terminal and the second terminal of the second receptacle. A second pair of side terminals of the switch are preferably individually electrically coupled with the first terminal and the second terminal of the second receptacle, in a manner opposite the first pair of side terminals of the switch. Thus, the first pair of side terminals and the second pair of side terminals are essentially electrically crossed. Therefore, by selecting either a first position or a second position of the switch, the user is able to select the first instance or the second instance of the electrical arrangement of the connector.

In use, the user physically joins the towed vehicle to the towing vehicle and physically mates the connector with the receiver electrically coupled with the wiring of the towing vehicle. In this manner, the components of the towed vehicle can receive the signals from the wiring of the towing vehicle through the connector. If the components of the towed vehicle do not operate properly, the user may actuate the switch between the first position and the second position. In this manner, the user can change the electrical arrangement between the first instance and the second instance described above.

It should be apparent that the user may effectively re-wire the connector, in a reversible fashion, without having to disassemble the housing and without the use of tools. By rewiring the connector, in this manner, the user is able to ensure that the wiring of the towing vehicle can easily be made compatible with the wiring of any towed vehicle.

BRIEF DESCRIPTION OF THE DRAWINGS

A preferred embodiment of the present invention is described in detail below with reference to the attached drawing figures, wherein.

DETAILED DESCRIPTION OF A PREFERRED EMBODIMENT

Figure 1:
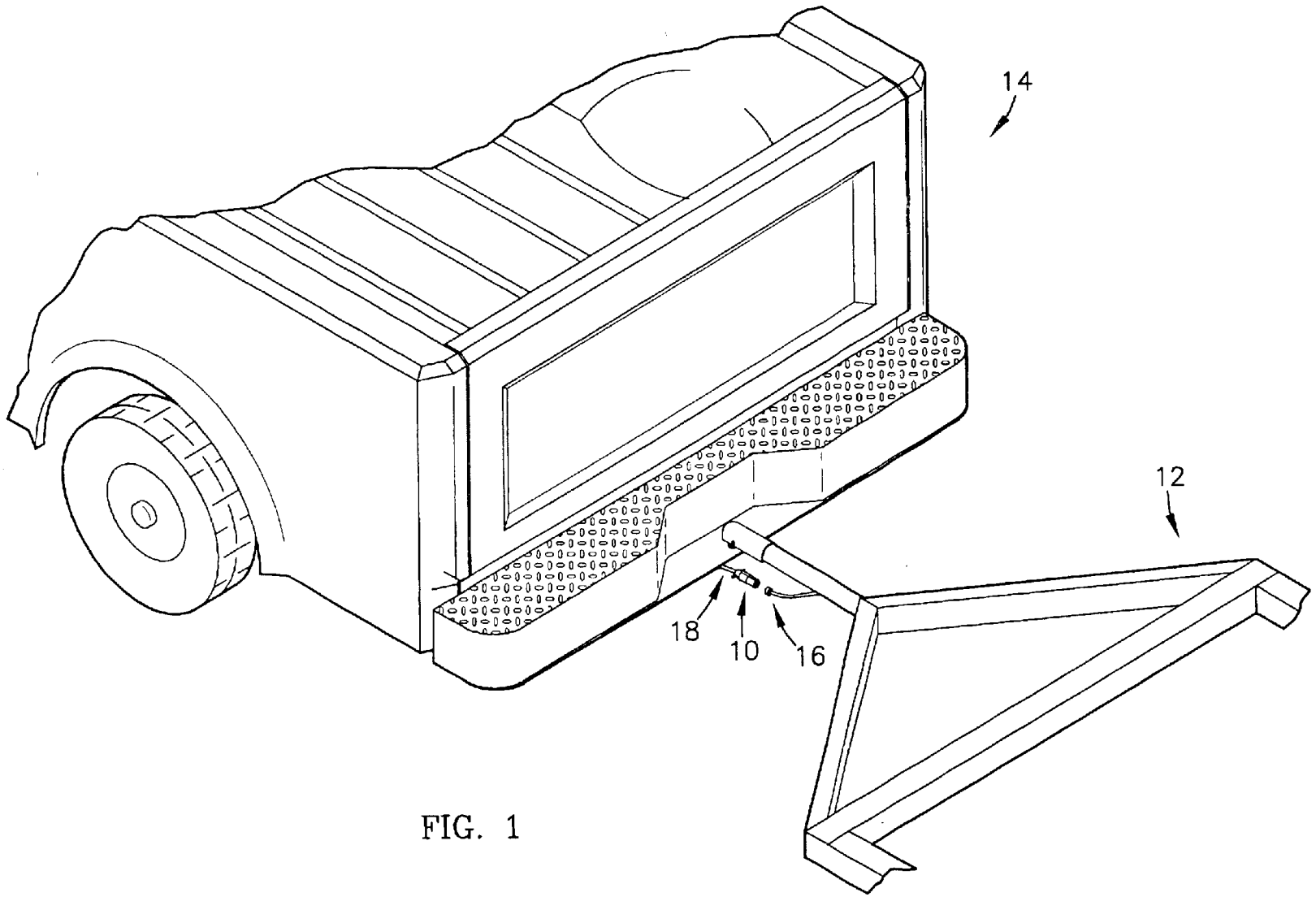
FIG. 1 is a perspective view of a first embodiment of a towing connector constructed in accordance with the present invention and shown electrically coupling a towed vehicle to a towing vehicle.

Referring to FIG. 1, the preferred connector 10 in accordance with the present invention is illustrated connected between a towed vehicle 12 and a towing vehicle 14. The connector 10 is preferably electrically coupled with the towing vehicle's 14 wiring. The connector 10 may be plugged into a receiver 16 which is preferably electrically coupled with the towed vehicle's 12 wiring. Alternatively, the connector 10 may be solidly mounted to the towing vehicle 14 and receive a member electrically coupled with the towed vehicle's 12 wiring. In either case, the connector 10 electrically couples the wiring of the towing vehicle 14 to the wiring of the towed vehicle 12.

For example, the wiring of the towed vehicle 12 may include electric brakes and/or other components that require electrical signals and/or auxiliary electrical power from the towing vehicle 14. The electric brakes aid the towing vehicle 14 is slowing the towed vehicle 12 and may also illuminate stop lights to indicate when the towed vehicle 12 is slowing down and/or stopping. Therefore, the wiring of the towing vehicle 14 preferably includes the signals and/or auxiliary power and preferably electrically couples with the connector 10 through a cable 18. Thus, as will be discussed further, the wiring of the towing vehicle 14 is preferably operable to electrically communicate the signals to the towed vehicle 12 through the cable 18, the connector 10, and the receiver 16.

Figure 2:
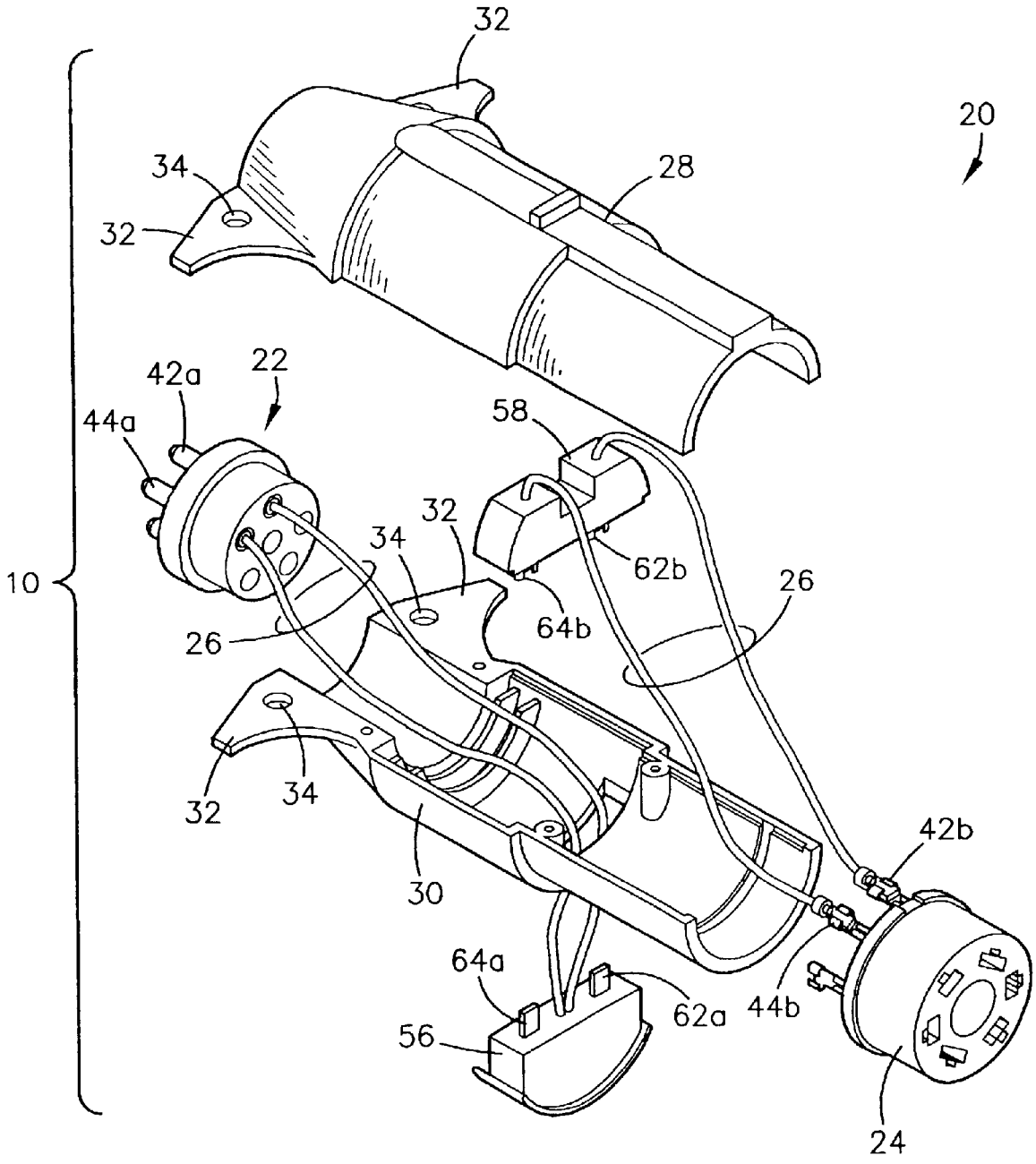
FIG. 2 is an exploded view of the connector of FIG. 1.

Referring also to FIG. 2, a preferred first embodiment of the connector 10 broadly comprises a housing 20, a first receptacle 22 mounted within a first portion of the housing 20 for electrically coupling with the cable 18, a second receptacle 24 mounted within a second portion of the housing 20 for electrically coupling with the receiver 16, and a plurality of wires 26 electrically coupling the first receptacle 22 with the second receptacle 24. The housing 20 is preferably constructed of plastic, but may be made of metal or any suitable material. The housing 20 preferably includes a first half-shell 28 and a second half-shell 30, which mate to form the housing 20. Each half-shell 28,30 preferably includes at least one mating tab 32 with a hole 34 through which a bolt may be inserted in order to securely hold the half-shells 28,30 together. The first portion of the housing 20 is preferably designed to securely hold the cable 18 without damaging the cable 18, while the second portion of the housing 20 is preferably designed to physically mate and electrically couple with the receiver 16.

The first receptacle 22 is preferably circular and mounts within the housing 20 between the cable 18 and the wires 26. A plurality of terminals preferably penetrate the first receptacle 22 in order to electrically couple the cable 18 with the wires 26. The terminals of the first receptacle 22 preferably individually electrically couple individual conductors of the cable 18 with each one of the wires 26. Alternatively, the individual conductors of the cable 18 may penetrate the first receptacle 22 and actually form the wires 26.

The second receptacle 24 is preferably circular and mounts within the housing 20 such that the wires 26 are located between the first receptacle 22 the second receptacle 24. A plurality of terminals preferably penetrate the second receptacle 24 in order to electrically couple the wires 26 with the receiver 16. The signals are received at the first receptacle 22 and transferred through the wires 26 to the second receptacle 24 where the signals are transferred to the wiring of the towed vehicle 12. In this manner, the connector 10 is operable to physically mate with the receiver 16 and transmit the signals from the towing vehicle 14 to the towed vehicle 12 through the receiver 16.

In order to make the wiring of the towed vehicle 12 compatible with the wiring of the towing vehicle 14, the wires 26 must be arranged in a specific electrical arrangement. The arrangement defines the manner in which the signals are transmitted from the wiring of the towing vehicle 14 to the wiring of the towed vehicle 12 through the connector 10. Thus, the arrangement is dependant upon specific characteristics of the towed vehicle 12 and the towing vehicle 14. Therefore, in order for the connector 10 to be operable with different combinations of towed vehicles 12 and towing vehicles 14, the arrangement may need to be modified.

Figure 3:
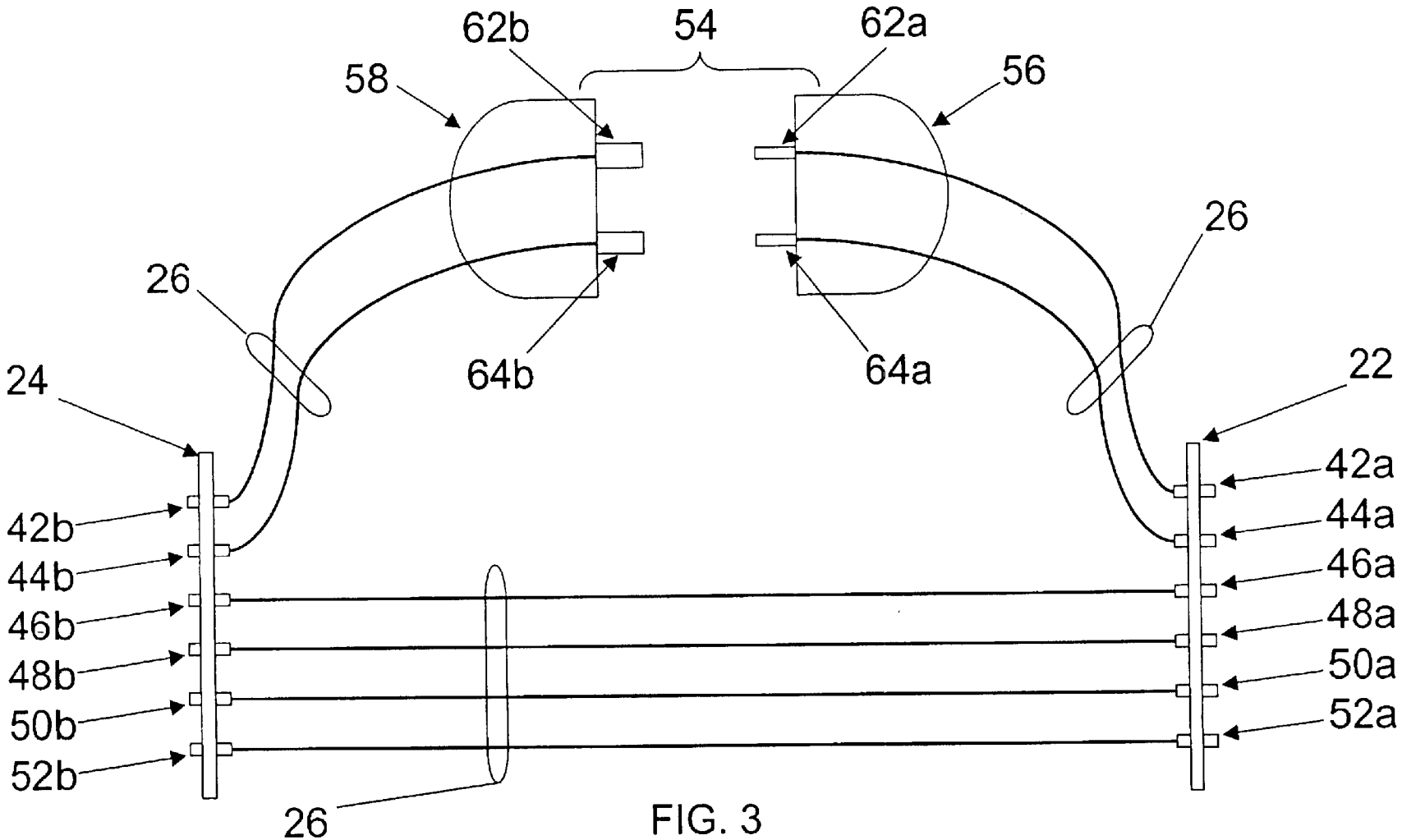
FIG. 3 is a schematic of a portion of the connector of FIG. 1.

In a first instance, referring also to FIG. 3, each of the wires 26 preferably electrically couple each terminal of the first receptacle 22 with a corresponding terminal of the second receptacle 24. For example, a first terminal 42*a* of the first receptacle 22 is preferably electrically coupled with a first terminal 42*b* of the second receptacle 24. Additionally, a second terminal 44*a* of the first receptacle 22 is preferably electrically coupled with a second terminal 44*b* of the second receptacle 24. Additionally, a third terminal 46*a* of the first receptacle 22 is preferably electrically coupled with a third terminal 46*b* of the second receptacle 24. Additionally, a fourth terminal 48*a* of the first receptacle 22 is preferably electrically coupled with a fourth terminal 48*b* of the second receptacle 24. Additionally, a fifth terminal 50*a* of the first receptacle 22 is preferably electrically coupled with a fifth terminal 50*b* of the second receptacle 24. Additionally, a sixth terminal 52*a* of the first receptacle 22 is preferably electrically coupled with a sixth terminal 52*b* of the second receptacle 24. In this manner, the connector 10 operates as a pass-thru type connector.

In a second instance, the first terminal 42*a* of the first receptacle 22 is preferably electrically coupled with the second terminal 44*b* of the second receptacle 24. Additionally, the second terminal 44*a* of the first receptacle 22 is preferably electrically coupled with the first terminal 42*b* of the second receptacle 24. The remaining terminals of the first receptacle 22 are preferably electrically coupled to the remaining terminals of the second receptacle 24 as described for the first instance above. In this manner, the connector 10 operates as a cross-over type connector, with the first and second terminals 42*a*,44*a* of the first receptacle 22 electrically crossed with the first and second terminals 42*b*,44*b* of the second receptacle 24.

The connector 10 of the present invention can operate as either the pass-thru type connector or the cross-over type connector described above using a mechanism 54 that modifies the electrical arrangement of two or more of the wires 26. The mechanism 54 preferably comprises a plug 56 removably mounted within the housing 20 and a mount 58 fixedly mounted within the housing 20. The plug 56 preferably includes at least two terminals. A first terminal 62*a* of the plug 56 is preferably electrically coupled to the first terminal 42*a* of the first receptacle 22 through a first wire. A second terminal 64*a* of the plug 56 is preferably electrically coupled to the second terminal 44*a* of the first receptacle 22 through a second wire.

The mount 58 similarly preferably includes at least two terminals. A first terminal 62*b* of the mount 58 is preferably electrically coupled to the first terminal 42*b* of the second receptacle 24 through a third wire. A second terminal 64*b* of the mount 58 is preferably electrically coupled to the second terminal 44*b* of the second receptacle 24 through a fourth wire.

A fifth wire preferably electrically couples the third terminal 46*a* of the first receptacle 22 to the third terminal 46*b* of the second receptacle 24. A sixth wire preferably electrically couples the fourth terminal 48*a* of the first receptacle 22 to the fourth terminal 48*b* of the second receptacle 24. A seventh wire preferably electrically couples the fifth terminal 50*a* of the first receptacle 22 to the fifth terminal 50*b* of the second receptacle 24. An eighth wire preferably electrically couples the sixth terminal 52*a* of the first receptacle 22 to the sixth terminal 52*b* of the second receptacle 24.

Additionally, the terminals 62*a*,64*a* of the plug 56 engage the terminals 62*b*,64*b* of the mount 58 when the plug 56 is received within the housing 20. In this manner, the plug 56 and the mount 58 combine to electrically couple the first terminal 42*a* and the second terminal 44*a* of the first receptacle 22 to the first terminal 42*b* and the second terminal 44*b* of the second receptacle 24 through the wires 26.

As discussed above, the plug 56 is removably mounted within the housing 20 and physically mates with the mount 58 such that the terminals 62*a*,64*a* of the plug 56 engage the terminals 62*b*,64*b* of the mount 58. The plug 56 is preferably designed to be received within the housing 20 in either one of two orientations, with the orientations being approximately 180 degrees apart. Additionally, the terminals 62*a*, 64*a* of the plug 56 are preferably designed to engage the terminals 62*b*,64*b* of the mount 58 in either one of the two orientations. Thus, the plug 56 may be removed, rotated 180 degrees and reinserted within the housing 20. This allows a user to change the electrical arrangement of the wires 26 from the first instance to the second instance described above, by operating the mechanism 54.

In the above example, when the plug 56 is inserted into the housing 20 in a first orientation, the first terminal 42*a* of the first receptacle 22 is electrically coupled to the first terminal 42*b* of the second receptacle 24, through the first wire, the first terminal 62*a* of the plug 56, the first terminal 62*b* of the mount 58, and the third wire. Additionally, the second terminal 44*a* of the first receptacle 22 is electrically coupled to the second terminal 44*b* of the second receptacle 24, through the second wire, the second terminal 64*a* of the plug 56, the second terminal 64*b* of the mount 58, and the fourth wire. In this case, the electrical arrangement corresponds to the first instance, with the connector 10 operating as the pass-thru type connector.

In the above example, when the plug 56 is inserted into the housing in a second orientation, the first terminal 42*a* of the first receptacle 22 is electrically coupled to the second terminal 44*b* of the second receptacle 24, through the first wire, the first terminal 62*a* of the plug 56, the second terminal 64*b* of the mount 58, and the fourth wire. Additionally, the second terminal 44*a* of the first receptacle 22 is electrically coupled to the first terminal 42*b* of the second receptacle 24, through the second wire, the second terminal 64*a* of the plug 56, the first terminal 62*b* of the mount 58, and the third wire. In this case, the electrical arrangement corresponds to the second instance, with the connector 10 operating as the cross-over type connector.

The mechanism 54 may be modified from that described above. For example, the first terminal 42*a* and the second terminal 44*a* of the first receptacle 22 may be electrically coupled to the mount 58, with the first terminal 42*b* and the second terminal 44*b* of the second receptacle 24 electrically coupled to the plug 56. It should be apparent that such a modification would not significantly alter the operation of the mechanism 54.

In use, the user physically joins the towed vehicle 12 to the towing vehicle 14 and physically mates the connector 10 with the receiver 16. In this manner, the components of the towed vehicle 12 can receive the signals from the wiring of the towing vehicle 14 through the connector 10. If the components of the towed vehicle 12 do not operate properly, the user may remove and rotate the plug 56 approximately 180 degrees. The user then reinserts the plug 56 into the housing 20. In this manner, the user can change the electrical arrangement between the first instance and the second instance described above.

Figure 4:
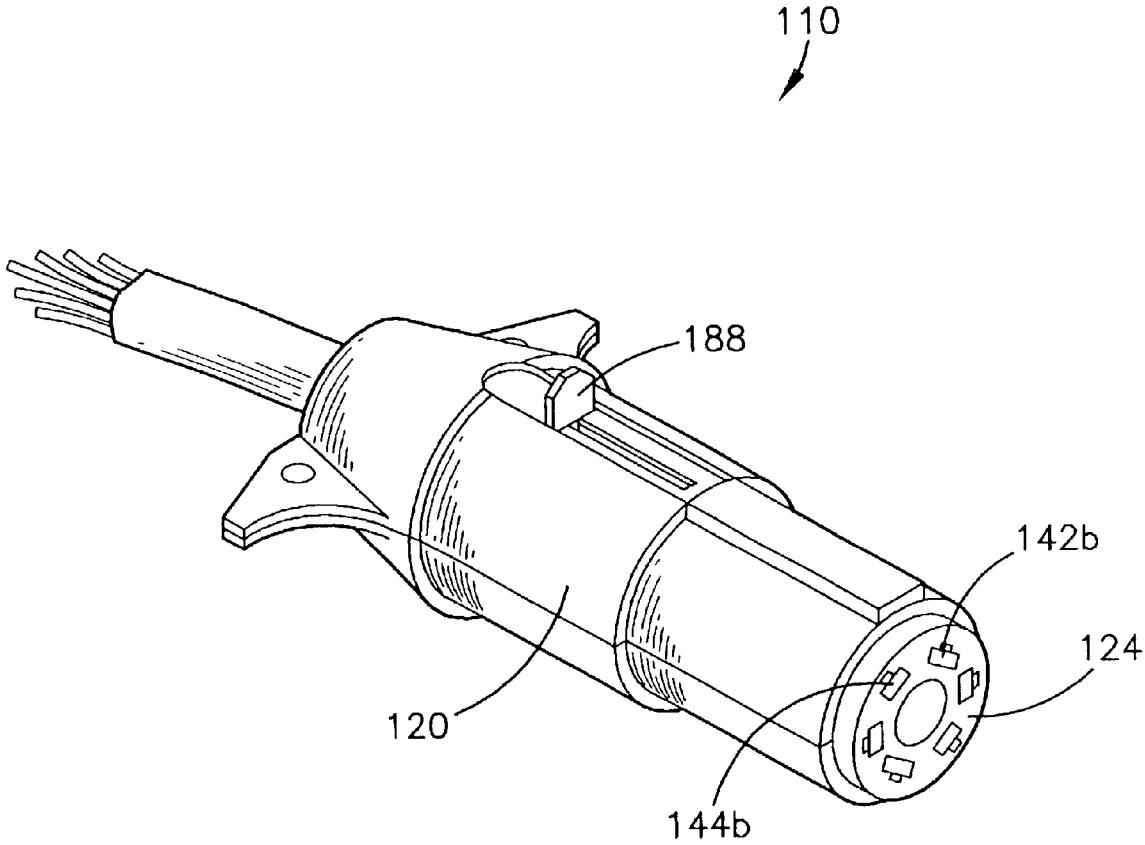
FIG. 4 is a perspective view of a second embodiment of a towing connector constructed in accordance with the present invention.
Figure 5:
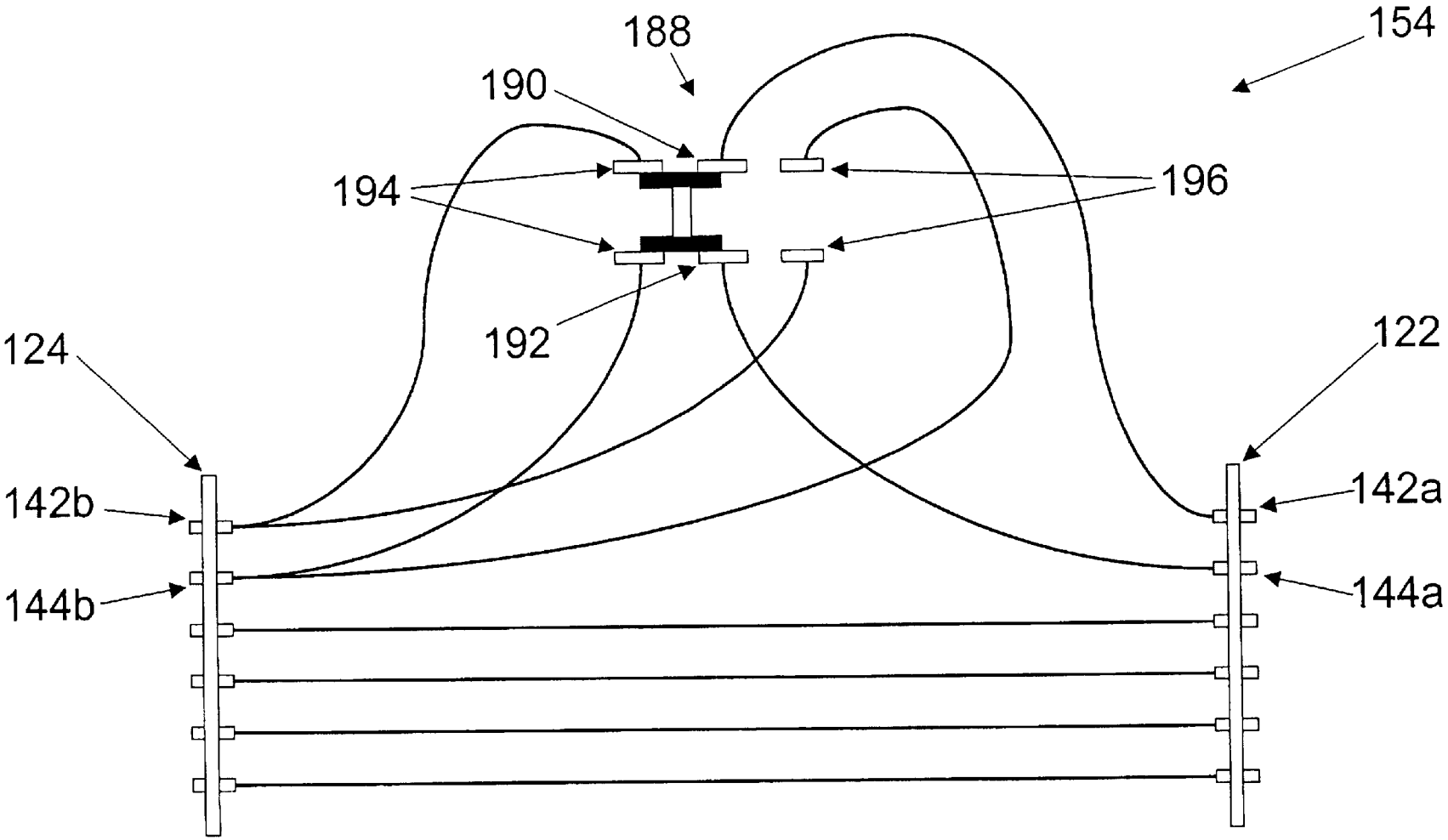
FIG. 5 is a schematic of a portion of the connector of FIG. 4.

Referring now to FIGS. 4 and 5, a preferred second embodiment of the connector 110 is similar to the preferred first embodiment of the connector 10. The most significant difference between the connectors 10,110 is that a mechanism 154 of the second embodiment of the connector 110 comprises a double-pole double-throw (DPDT) switch 188 disposed within a housing 120. A first center terminal 190 of the switch 188 is preferably electrically coupled with a first terminal 142*a* of a first receptacle 122 and a second center terminal 192 of the switch 188 is preferably electrically coupled with a second terminal 144*a* of the first receptacle 122. A first pair of side terminals 194 of the switch 188 are preferably individually electrically coupled with a first terminal 142*b* and a second terminal 144*b* of a second receptacle 124. A second pair of side terminals 196 of the switch 188 are preferably individually electrically coupled with the first terminal 142*b* and the second terminal 144*b* of the second receptacle 124, in a manner opposite the first pair of side terminals 194 of the switch 188. Thus, the first pair of side terminals 194 and the second pair of side terminals 196 are essentially electrically crossed. Therefore, by selecting either a first position or a second position of the switch 188, the user is able to select the first instance or the second instance of the electrical arrangement of the connector 110.

The mechanism 154 may be modified from that described above. For example, the first terminal 142*a* and the second terminal 144*a* of the first receptacle 122 may be electrically coupled to the side terminals 194,196 of the switch 188, with the first terminal 142*b* and the second terminal 144*b* of the second receptacle 124 electrically coupled to the center terminals 190,192 of the switch 188. It should be apparent that such a modification would not significantly alter the operation of the mechanism 154.

In use, the user physically joins the towed vehicle 12 to the towing vehicle 14 and physically mates the connector 110 to the receiver 16. In this manner, the components of the towed vehicle 12 can receive the signals from the wiring of the towing vehicle 14 through the connector 110. If the components of the towed vehicle 12 do not operate properly, the user may actuate the switch 188 between the first position and the second position. In this manner, the user can change the electrical arrangement between the first instance and the second instance described above.

It should be apparent that the user may effectively re-wire the connector 10,110, in a reversible fashion, without having to disassemble the housing 20,120 and without the use of tools. By rewiring the connector 10,110, in this manner, the user is able to ensure that the wiring of the towed vehicle 12 can easily be made compatible with the wiring of any towing vehicle 14.

While the present invention has been described above, it is understood that other materials and/or dimensions can be substituted. Additionally, there may be any number of wires 26. Furthermore, the mechanism 54,154 may change the electrical arrangement of any number of the wires 26. Finally, the mechanism 54,154 may change the electrical arrangement of any of the wires 26.

Additionally, the connector 10,110 may be designed to be independent of and separate from the cable 18. In this case, the cable 18 may be terminated into an outlet of the towing vehicle 14 and the connector 10,110 may be designed to be positioned between the outlet and the receiver 16. It should be apparent that the connector 10,110 is still able to ensure that the wiring of any towed vehicle 12 can easily be made compatible with the wiring of the towing vehicle 14.

Furthermore, the connector 10,110 may be electrically coupled with the wiring of the towed vehicle 12 and mate with the outlet of the towing vehicle 14. It should be apparent that the connector 10,110 is still able to ensure that the wiring of any towed vehicle 12 can easily be made compatible with the wiring of the towing vehicle 14.

Finally, the connector 10 may be used to communicate any electrical signal and/or supply electrical power between the towed vehicle 12 and the towing vehicle 14, such as signals for lights. The connector 10 may also be used to communicate signals and/or supply electrical power from the towed vehicle 12 to the towing vehicle 14. These and other minor modifications are within the scope of the present invention.

Having thus described a preferred embodiment of the invention, what is claimed as new and desired to be protected by Letters Patent includes the following:

1. A connector for connecting wiring of a towed vehicle to wiring of a towing vehicle, the connector comprising:

a housing;

a plurality of wires disposed within the housing and operable to convey electrical signals through the housing according to an electrical arrangement; and a mechanism operable to modify the electrical arrangement of at least two of the wires, the mechanism including a mount, and a reversible plug operable to engage the mount in either of two orientations and thereby modify the arrangement of at least two of the wires.

2. The connector as set forth in claim 1, wherein the mount is substantially fixedly mounted within the housing.

3. The connector as set forth in claim 1, wherein the plug is removably mounted within the housing.

4. The connector as set forth in claim 1, wherein the mount includes two terminals.

5. The connector as set forth in claim 1, wherein the plug includes two terminals.

6. A connector for connecting wiring of a towed vehicle to wiring of a towing vehicle, the connector comprising:

a substantially cylindrical housing with a first end and a second end;

a first receptacle disposed within the first end of the housing and including a plurality of terminals;

a second receptacle disposed within the second end of the housing and including a plurality of terminals;

a plurality of wires operable to individually electrically couple at least some of the terminals of the first receptacle to at least some of the terminals of the second receptacle;

a mount fixedly disposed within the housing and including at least two terminals with each terminal electrically coupled to a different one of the terminals the second receptacle; and a plug reversibly disposed within the housing and including at least two terminals with each terminal electrically coupled to a different one of the terminals of the first receptacle and operable to mate with the terminals of the mount, wherein the plug may be at least partially removed, rotated approximately 180 degrees, and reinserted into the housing thereby modifying an electrical arrangement of at least two of the wires and the manner in which the first receptacle is electrically coupled to the second receptacle.

* * * * *